United States Patent [19]

Miller

[11] 4,089,502

[45] May 16, 1978

[54] MODULAR KNOCK-OUT CAVITY FORMING INSERTS

[76] Inventor: Arthur C. Miller, Rte. 29 Devevalt, Birchrunville, Pa. 19432

[21] Appl. No.: 776,334

[22] Filed: Mar. 10, 1977

[51] Int. Cl.[2] ..... B28B 7/34

[52] U.S. Cl. ..... 249/177; 249/175

[58] Field of Search ..... 249/39, 175–177, 249/183; 52/576, 577, 325; 220/23.4

[56] References Cited

U.S. PATENT DOCUMENTS

| | | | |
|---|---|---|---|
| 2,614,310 | 10/1952 | James | 249/183 |
| 2,623,261 | 12/1952 | Semeraro | 249/183 |
| 3,488,027 | 1/1970 | Evans | 249/175 |
| 3,763,980 | 10/1973 | Vom Stein et al. | 220/23.4 |

FOREIGN PATENT DOCUMENTS

| | | | |
|---|---|---|---|
| 444,454 | 2/1968 | Switzerland | 52/577 |

*Primary Examiner*—Francis S. Husar
*Assistant Examiner*—John McQuade
*Attorney, Agent, or Firm*—Seidel, Gonda & Goldhammer

[57] ABSTRACT

Knock-out inserts are injected molded of plastic with outwardly directed outside walls and inside panels. Opposite inside panels are each provided with a pair of spaced locking means so that the body of one insert may be coupled to mating locking means on an adjacent insert after removal of the associated outside walls.

11 Claims, 5 Drawing Figures

FIG. 1
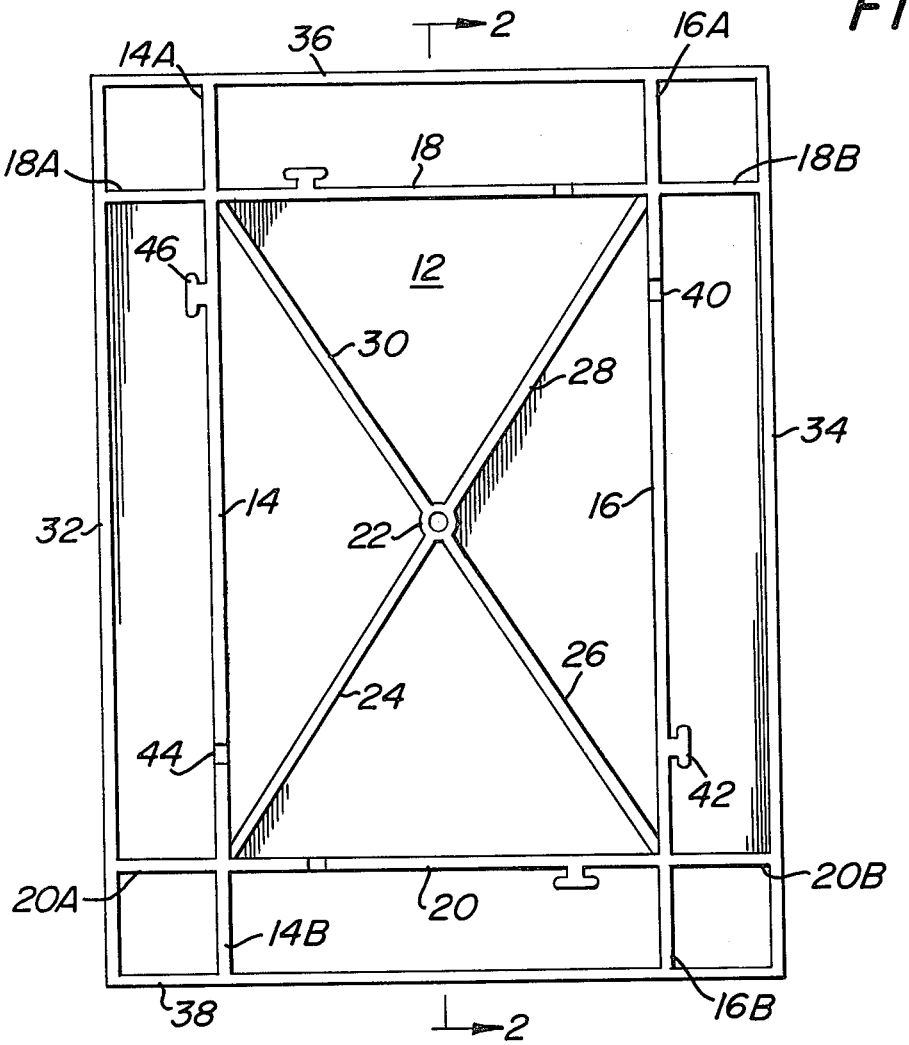
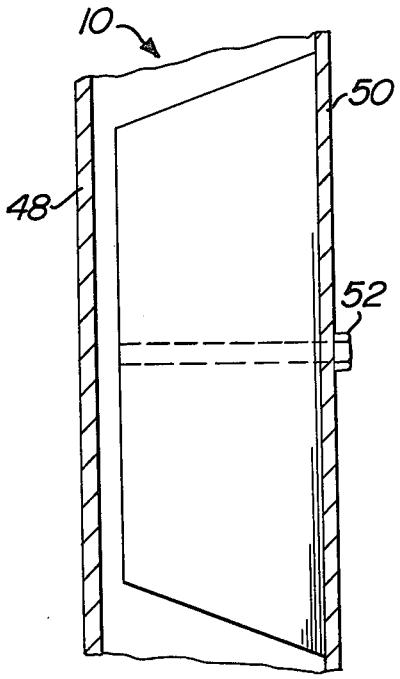
FIG. 5

MODULAR KNOCK-OUT CAVITY FORMING INSERTS

BACKGROUND

A knock-out insert is a device which is inserted into a mold to thereby provide a cavity or opening in the end product. In the concrete industry, it is conventional to provide a concrete housing with a plurality of knock-out openings wherein the concrete is very thin so as to facilitate access to the concrete housing at a plurality of locations.

Knock-out inserts are generally made from sheet metal or wood on a custom basis. I have found that knock-out inserts can be manufactured more economically in the form of modules capable of being coupled together whereby it is possible to meet the demands of most sizes for knock-out inserts. At the same time, the knock-out inserts are capable of being interconnected with one another without the use of bolts or moving parts.

SUMMARY OF THE INVENTION

The present invention is directed to a modular knock-out insert having a body provided with a bottom wall connected to upstanding, outwardly directed end and side walls. Within the periphery of said side and end walls, the body is provided with internal side and end panels. The side and end panels are generally perpendicular to the bottom wall and are connected thereto adjacent the intersection between the bottom wall, the end walls and the side walls.

Each side panel has a pair of spaced locking means for facilitating securement of one body with another body which is similarly constructed and having mating locking means on a similar side panel. The juxtaposed bodies may be releaseably interconnected after removal of the associated side walls. In this manner, a knock-out insert can be made and be comprised of a plurality of modules interconnected without the use of bolts, separable fasteners, or moving parts.

It is an object of the present invention to provide a novel modular knock-out insert wherein a pair of such inserts may be removably coupled together without using separate fasteners, separate bolts, or moving parts.

Other objects will appear hereinafter.

For the purpose of illustrating the invention, there is shown in the drawings a form which is presently preferred; it being understood, however, that this invention is not limited to the precise arrangements and instrumentalities shown.

FIG. 1 is a plan view of an insert in accordance with the present invention.

FIG. 5 is a sectional view through the walls of a mold showing an insert mounted therebetween.

Referring to the drawings in detail, wherein like numerals indicate like elements, there is shown in FIG. 1 a plan view of an insert in accordance with the present invention designated generally as 10.

Figure 2:
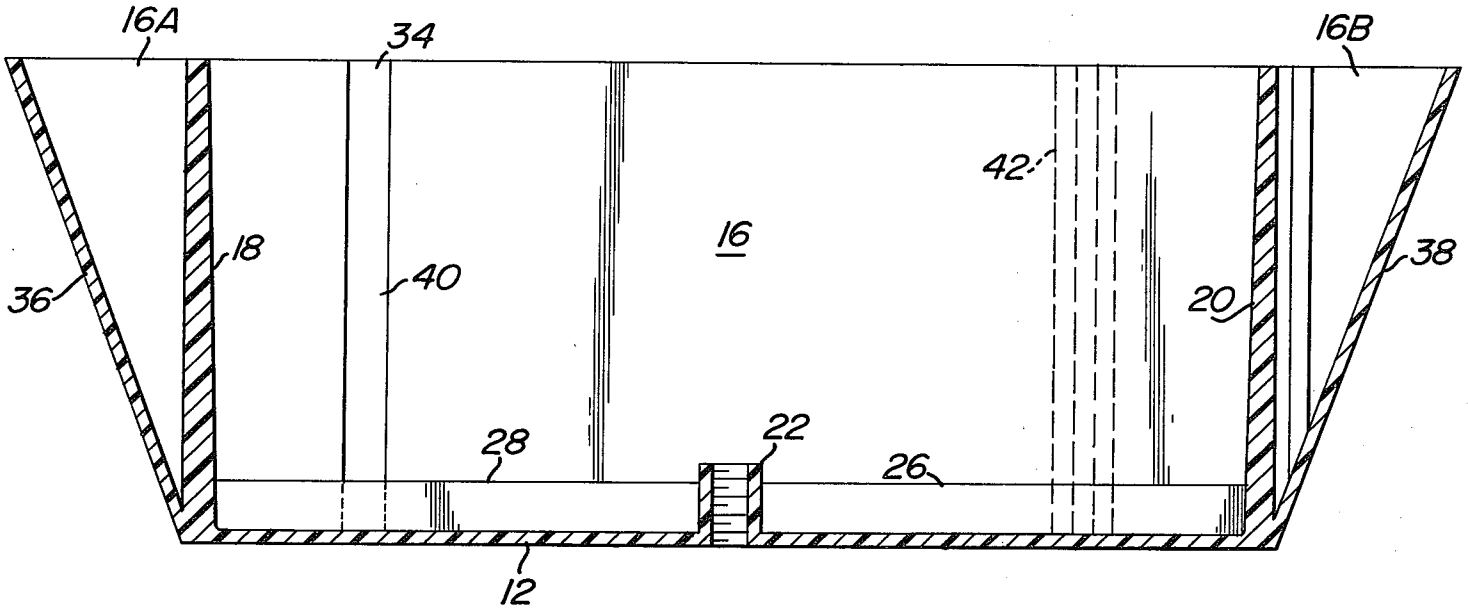
FIG. 2 is a sectional view taken along the line 2—2 of FIG. 1 but on an enlarged scale.

Referring to FIGS. 1 and 2, it will be noted that the insert 10 is integral in one piece and preferably is injection molded from a rigid, polymeric plastic material such as high density polyethylene. Other polymeric plastics which are rigid, nonhydroscopic, inexpensive, light in weight, are tough and have good abrasive resistance may be used.

The insert 10 includes a bottom wall 12 having upstanding panels 14, 16 interconnected with upstanding panels 18, 20. Referring to FIG. 2, the panels 14–20 have a slight draft on their inner surface but are provided with an outer surface perpendicular to the planar bottom wall 12. The shape or configuration of the bottom wall 12 and panels 14–20 may be varied substantially. I prefer to make the bottom wall 12 a rectangle having dimensions such as 9 inches by 12 inches with the panels 14–20 having a height of about 4 inches. I have found that the dimensions will enable the insert to be used in connection with most concrete structures that are poured. Of course the dimensions may be changed as desired.

On its inner surface, the bottom wall 12 is provided with a centrally disposed tubular portion 22 having internal threads. Ribs 24, 26, 28 and 30 extend from portion 22 to one of the corners. Thus, rib 24 extends to the corner defined by the intersection of side panel 14 and end panel 20. As will be apparent from FIG. 2, the height of the ribs is less than the height of the portion 22. The ribs 24–30 reinforce and stiffen the bottom wall 12.

Peripheral walls surround the panels 14–20. Thus, side wall 32 extends upwardly and outwardly from the intersection of side panel 14 and bottom wall 12. Side wall 34 extends upwardly and outwardly from the intersection of side panel 16 and the bottom wall 12. End wall 36 extends upwardly and outwardly from the intersection of end panel 18 and the bottom wall 12. End wall 38 extends upwardly and outwardly from the intersection of the end panel 20 and the bottom wall 12. The included angle of the peripheral walls with respect to the adjacent panel may vary between 5 and 25 degrees. The peripheral walls assure that the insert can be removed from the poured concrete after the concrete has hardened.

To add rigidity to the insert, side panel 14 has extensions 14A and 14B. Side panel 16 has extensions 16A and 16B. End panel 18 has extensions 18A and 18B. End panel 20 has extensions 20A and 20B. The extensions extend for the full height of the respective panels. As shown more clearly in FIG. 2, the tapered walls extend for a height corresponding to the height of the panels whereby the insert has planar faces on opposite sides.

The insert 10 may be used as an insert in and of itself or may be coupled to form a composite insert formed of modules. To facilitate the coupling of two adjacent inserts without using any separate fasteners, bolts, nails, or moving parts, each of the side panels 14 and 16 is provided with a pair of locking means. Side panel 16 has locking means in the form of a slot 40 and a T-shaped tongue 42 spaced therefrom. Side panel 14 has a slot 44 and a T-shaped tongue 46 similarly spaced therefrom. The T-shaped tongues 42, 46 are adjacent diagonally opposite corners. The slots 40, 42 are similarly located. End panels 18, 20 are similary provided with slots and T-shaped tongues.

The insert 10 may be located between walls 48, 50 of a mold and secured to one of the walls such as wall 50 by bolt 52. When concrete is poured into the space between the mold walls 48, 50, and permitted to harden, it will have a recess on one surface and will be smooth on the opposite surface. The recess generally does not extend all the way through the thickness of the concrete wall but may be so provided if desired. The shallow or thin portion of the wall is easily knocked out to thereby provide an opening through the concrete wall.

If the sides of the knock-out opening in the concrete wall is larger than the size of a single insert 10, two or more inserts may be readily coupled together to enlarge the size of the knock-out opening or recess. To couple insert 10 with a similar insert designated 10', it is only necessary to remove one peripheral wall on each insert.

Figure 3:
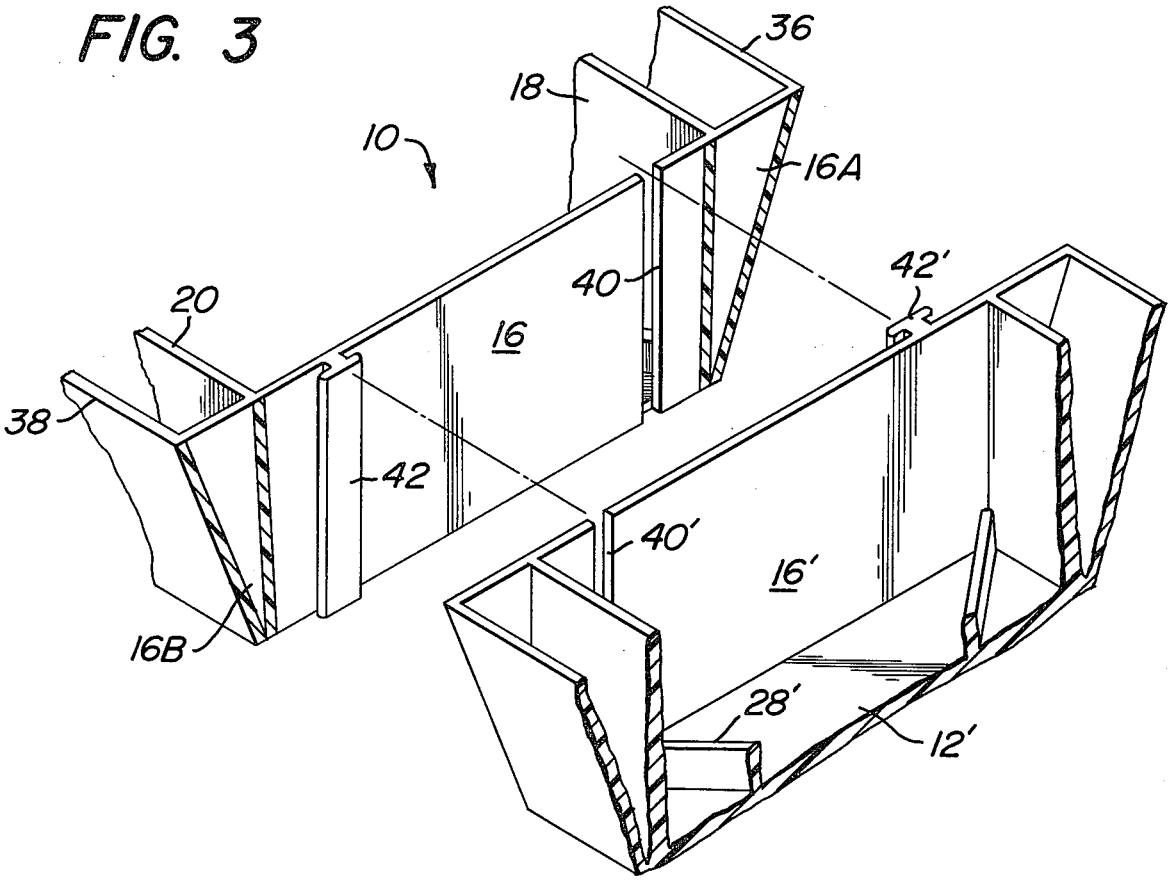
FIG. 3 is an exploded partial perspective view of two adjacent inserts.
Figure 4:
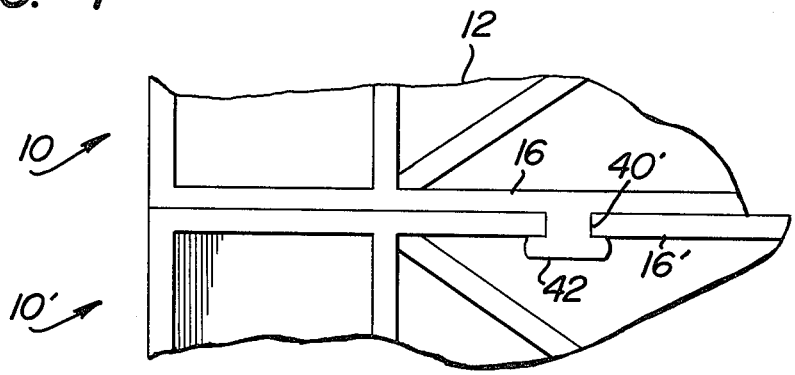
FIG. 4 is a partial plan view showing two inserts coupled together.

Referring to FIG. 3, side wall 34 has been removed by sawing or cutting the same thereby exposing slot 40 and T-shaped tongue 42. By removing a similar wall on one side of insert 10', there is exposed the slot 40' opposite tongue 42 and a tongue 42' opposite the slot 40. By superimposing insert 10' over insert 10 and then sliding insert 10' downwardly, tongue 42 will cooperate with slot 40' and tongue 42' will cooperate with slot 40 to couple panel 16 to panel 16'. See FIG. 4. If desired, adhesive may be applied to the juxtaposed surfaces on panels 16, 16'.

As shown more clearly in FIGS. 1 and 2, the entire outer periphery of the insert 10 is defined by upwardly and outwardly directed walls. Since only juxtaposed walls on mating faces of inserts 10 and 10' have been removed by sawing or cutting, when two inserts are coupled together the resultant likewise has upwardly and outwardly directed walls on its entire periphery. A plurality of inserts may be interconnected with one another to define a peripheral contour which is rectangular, L-shaped, an annular rectangle, etc.

Thus, it will be noted that the modular insert of the present invention may be used singularly or in combination with other inserts to provide an inexpensive rigid knock-out insert which may be used in connection with pouring of concrete constructions desired to have an opening or knock-out thin section. The inserts are reusable and may be inexpensively manufactured for use as prefabricated inserts instead of custom making an insert for each pouring. Since the inserts are preferably made from a polymeric plastic which is nonhydroscopic, they have advantages over inserts made out of wood which absorb moisture and swell thereby limiting the use of wooden inserts. Since each insert is prefabricated by molding the same, uniformity of size of the recess or knock-out opening is assured.

The present invention may be embodied in other specific forms without departing from the spirit or essential attributes thereof and, accordingly, reference should be made to the appended claims, rather than to the foregoing specification as indicating the scope of the invention.

I claim:

1. A modular knock-out insert comprising a body having a bottom wall connected to upstanding outwardly directed end and side walls constituting peripheral walls, said bottom wall being in one piece with said end and side walls, internal side and end panels extending generally perpendicular to said bottom wall, said panels and bottom wall being integral in one piece and connected adjacent the intersection between said bottom wall and said peripheral walls, at least one of said panels having a pair of spaced locking means for securement with mating locking means on another body.

2. An insert in accordance with claim 1 wherein said body is a rigid polymeric plastic material, the height of said panels being not greater than the height of said peripheral walls, and wall means interconnecting said panels with said peripheral walls adjacent the corners thereof.

3. An insert in accordance with claim 1 wherein the locking means on one panel includes a slot in said one panel spaced from a parallel T-shaped tongue, the cross portion of the tongue being spaced from its panel by a distance corresponding generally to the thickness of the panel, said tongue being disposed in the space between its panel and the associated peripheral wall.

4. An insert in accordance with claim 1 including means defining a threaded surface in a central location on said bottom wall to facilitate coupling a bolt to the body for mounting the same in conjunction with a mold wall.

5. An insert in accordance with claim 4 including ribs on the inner surface of said bottom wall, said ribs being in one piece with said bottom wall and said means defining said threaded surface.

6. An insert in accordance with claim 1 wherein said locking means is integral in one piece with opposite panels so that two bodies may be joined together without the use of separate fasteners or moving parts.

7. An insert in accordance with claim 6 wherein said locking means includes a tongue and slot in oppositely disposed panels, the slots being generally diagonally opposite one one another, each tongue being opposite a slot on the opposite panel.

8. A modular knock-out insert comprising a generally dish-shaped body having a bottom wall with peripheral walls extending upwardly and outwardly therefrom, said bottom wall having panels radially inwardly from said peripheral walls, each panel being opposite one of said peripheral walls, the panels being perpendicular to the bottom wall and being integral in one piece therewith, means interconnecting the panels with a juxtaposed one of said peripheral walls, the height of the panels corresponding generally to the height of the peripheral walls, said body being made from a rigid polymeric plastic material, and a pair of spaced locking means on at least one of said panels to facilitate securing one body to another without any moving parts.

9. An insert in accordance with claim 8 wherein at least one of the locking means projects from its panel into the space between its panel and the juxtaposed peripheral wall.

10. An insert in accordance with claim 8 wherein said bottom wall is rectangular with four of said peripheral walls, each panel having a pair of said locking means.

11. A modular knock-out insert comprising a rigid plastic body having a rectangular bottom wall connected to upstanding outwardly directed end and side walls, said bottom wall being in one piece with said end and side walls, internal side and end panels extending generally perpendicular to said bottom wall, said panels and bottom wall being integral in one piece and connected adjacent the intersection between said bottom wall and its side and end walls, the height of said panels being not greater than the height of said end and side walls, wall means interconnecting each of said panels adjacent the ends thereof to one of said side and end walls, and means on said body to facilitate mounting the body in conjunction with a mold wall.

* * * * *